US007318480B2

(12) United States Patent
Hosie et al.

(10) Patent No.: US 7,318,480 B2
(45) Date of Patent: Jan. 15, 2008

(54) TUBING RUNNING EQUIPMENT FOR OFFSHORE RIG WITH SURFACE BLOWOUT PREVENTER

(75) Inventors: Stanley Hosie, Katy, TX (US); David S. Christie, Scotland (GB); Alistair MacDonald, Scotland (GB); Paul Findlay Milne, Scotland (GB)

(73) Assignee: Vetco Gray Inc., Houston, TX (US)

( * ) Notice: Subject to any disclaimer, the term of this patent is extended or adjusted under 35 U.S.C. 154(b) by 23 days.

(21) Appl. No.: 11/219,443

(22) Filed: Sep. 2, 2005

(65) Prior Publication Data

US 2006/0042791 A1 Mar. 2, 2006

Related U.S. Application Data

(60) Provisional application No. 60/606,588, filed on Sep. 2, 2004.

(51) Int. Cl.
*E21B 29/12* (2006.01)

(52) U.S. Cl. ..... 166/367; 166/338; 166/360; 166/255.2

(58) Field of Classification Search ..... 166/345, 166/338, 339, 72, 336, 352, 360, 367, 368, 166/378, 381, 85.4, 255.2
See application file for complete search history.

(56) References Cited

U.S. PATENT DOCUMENTS 3,590,920 A 7/1971 Orund et al.
3,766,978 A 10/1973 Orund et al.
4,095,421 A 6/1978 Silcox
4,174,000 A * 11/1979 Milberger ..... 166/363
4,337,829 A * 7/1982 Banzoli et al. ..... 166/366
4,375,835 A * 3/1983 Archer ..... 166/339
4,658,904 A * 4/1987 Doremus et al. ..... 166/336
5,685,380 A 11/1997 Purcell et al.
5,819,852 A 10/1998 Cunningham et al.
5,941,310 A 8/1999 Cunningham et al.
6,227,300 B1 5/2001 Cunningham et al.
6,293,345 B1 9/2001 Watkins
6,321,846 B1 * 11/2001 Rytlewski ..... 166/363
6,343,654 B1 2/2002 Brammer
6,408,947 B1 6/2002 Cunningham et al.
6,536,529 B1 3/2003 Kerr et al.
6,622,799 B2 * 9/2003 Dean ..... 166/381
6,644,410 B1 11/2003 Lindsey-Curran et al.
6,693,554 B2 2/2004 Beique et al.
6,715,554 B1 4/2004 Cunningham et al.

(Continued)

*Primary Examiner*—Thomas A Beach
(74) *Attorney, Agent, or Firm*—Bracewell & Giuliani LLP

(57) ABSTRACT

A method performing an operation in a subsea wellhead assembly through a riser extending between the wellhead assembly and a surface platform includes the step of connecting a surface blowout preventer to an upper portion of the riser. Then a tool is connected to a string of conduit. A control line is then connected to the tool, extended alongside the conduit. The tool and control line are lowered through the blowout preventer and riser. The method also includes the step of mounting a slick joint to an upper end of the conduit when the tool is near the wellhead assembly. The control line is then linked through the slick joint and extends to the surface platform. The method also includes the step of communicating with the tool via the control line and performing an operation in the wellhead assembly with the tool.

19 Claims, 5 Drawing Sheets

U.S. PATENT DOCUMENTS 6,988,554 B2 * 1/2006 Bodine et al. ..... 166/363
7,011,152 B2 * 3/2006 Soelvik ..... 166/65.1
2002/0100589 A1 * 8/2002 Childers et al. ..... 166/339
2002/0112860 A1 * 8/2002 McDaniel ..... 166/381
2004/0099420 A1 5/2004 Kotrla et al.
2004/0168811 A1 * 9/2004 Shaw et al. ..... 166/368
2006/0065401 A1 * 3/2006 Allen et al. ..... 166/345

* cited by examiner

TUBING RUNNING EQUIPMENT FOR OFFSHORE RIG WITH SURFACE BLOWOUT PREVENTER

RELATED APPLICATIONS

Applicant claims priority to the application described herein through a U.S. provisional patent application titled "Tubing Running Equipment For Offshore Rig With Surface Blowout Preventer," having U.S. patent application Ser. No. 60/606,588, which was filed on Sep. 2, 2004, and which is incorporated herein by reference in its entirety.

BACKGROUND OF INVENTION

1. Field of the Invention

This invention relates in general to offshore drilling, and in particular to equipment and methods for running tubing or casing with an offshore rig that uses a surface blowout preventer.

2. Background of the Invention

When completing a subsea well for subsea production, a riser extends from a surface vessel and attaches to the subsea well. A tubing hanger is lowered with a conduit through the riser and landed in the tubing spool and wellhead assembly. A tubing hanger running tool that is connected to the upper end of the tubing hanger sets the seal and locking member of landing of the tubing hanger. A control line extends from the running tool alongside the conduit to the surface platform. A lower marine riser package ("LMRP") and subsea blowout preventer ("BOP") can be utilized for safety and pressure control. In arrangements in which the BOP provides the main basis for pressure control, the BOP typically closes in on and engages the outer surface of the tubing hanger running tool.

During certain completion operations, the operator closes the BOP on the outer surface of the tubing hanger running tool. This enables the operator to apply pressure to the tubing hanger for testing purposes. Circulation operations can be performed through the subsea well with the fluid line or the conduit in the riser as either return or entry ways for the fluid. One of the drawbacks of these arrangements is that the LMRP/BOP is very large and bulky with numerous electrical and hydraulic control lines extending from the surface vessel in order to monitor and operate the subsea LMRP/BOP. The drilling riser typically has a large diameter and has a large number of lines extending alongside.

Accordingly, it has been proposed to utilize a surface (BOP) with a smaller subsea disconnect package during completion work on the subsea well. The surface BOP provides well control during the drilling and completion operations. The subsea disconnect package comprises a smaller, less complex assembly, which allows for emergency release of the rig from the well. The riser may be less complex, such as one using threaded joints.

An umbilical is attached to the tubing hanger running tool for supplying hydraulic fluid to the tool to perform various tasks. With a conventional subsea LMRP, the BOP closes on the running tool at a point below the attachment of the umbilical to the running tool. Normally, a BOP cannot seal around a conduit if the umbilical is alongside without damaging the umbilical. This prevents a surface BOP from being used for completion operations in the same manner as a subsea LMRP.

SUMMARY OF THE INVENTION

A method performing an operation in a subsea wellhead assembly through a riser extending between the wellhead assembly and a surface platform includes the step of connecting a surface blowout preventer to an upper portion of the riser. Then a tool is connected to a string of conduit. A control line is then connected to the tool, extended alongside the conduit. The tool and control line are lowered through the blowout preventer and riser. The method also includes the step of mounting a slick joint to an upper end of the conduit when the tool is near the wellhead assembly. The control line is then linked through the slick joint and extends to the surface platform. The method also includes the step of communicating with the tool via the control line and performing an operation in the wellhead assembly with the tool.

The method can further include the step of closing the blowout preventer on the slick joint and applying pressure to the interior of the riser around the string of conduit. The method can also include the step of closing the blowout preventer on the slick joint and flowing fluid through a bore in the slick joint. The communicating with the tool via the control line can include sending electrical signals through the control line. When the control line is linked through the slick joint, the step can include connecting the control line to a control line segment that extends through a passage in the slick joint.

The tool can be a running tool for running a string of pipe into the well. In which case, the method can also include the step of setting with the running tool a hanger at an upper end of the pipe, wherein the hanger is set sealingly in the wellhead assembly.

DETAILED DESCRIPTION OF THE PREFERRED EMBODIMENTS

Figure 1:
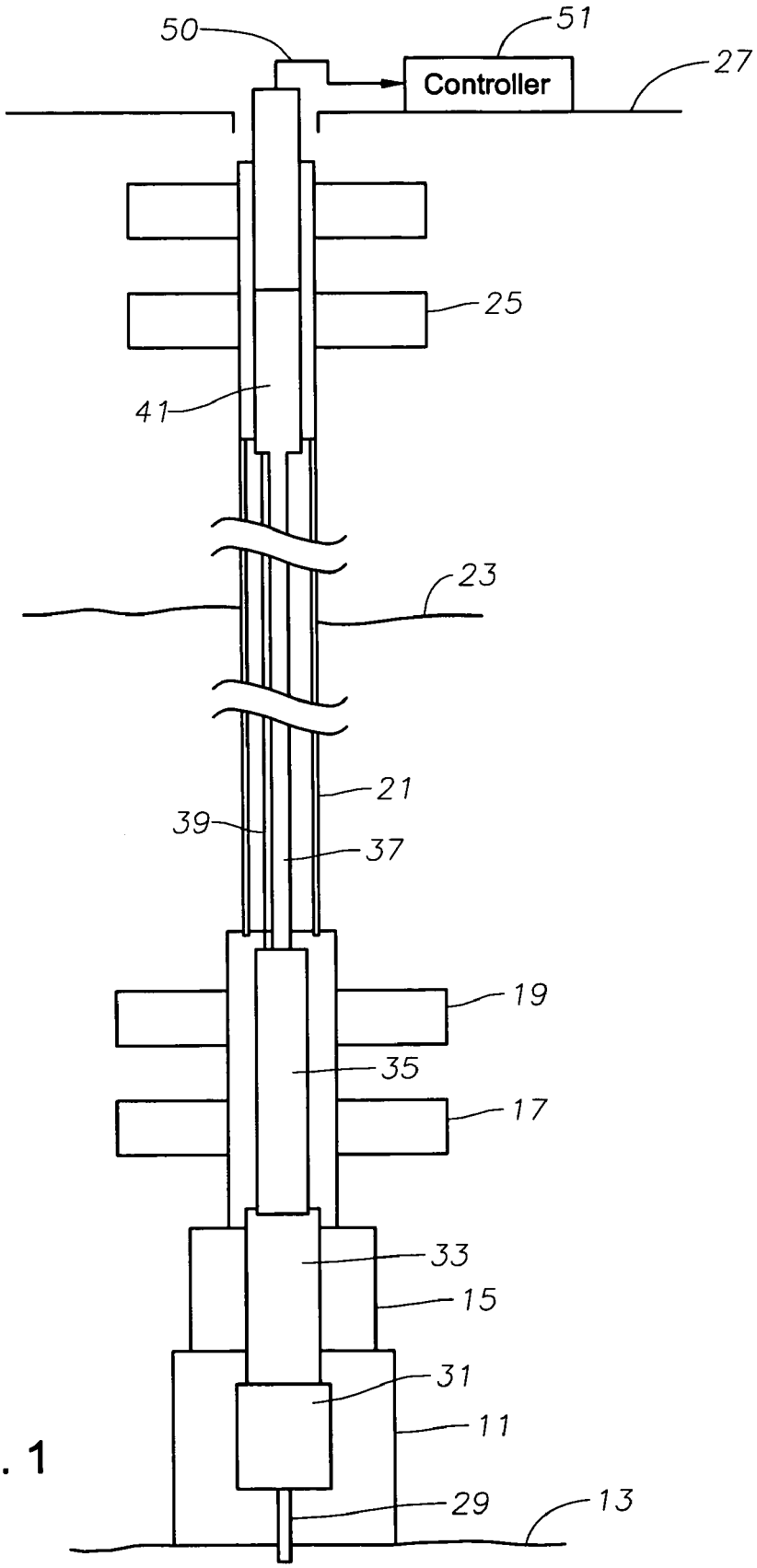
FIG. 1 is a schematic view of a tubing hanger being run through a riser system in accordance with the first embodiment of this invention.

Referring to FIG. 1, a wellhead 11 is schematically shown located at sea floor 13. Wellhead 11 may be a wellhead housing, a tubing hanger spool, or a Christmas tree of a type that supports a tubing hanger within. An adapter 15 connects wellhead 11 to a subsea set of pipe rams 17. Pipe rams 17 will seal around pipe of a designated size range but will not fully close access to the well if no pipe is present. The subsea pressure control equipment also includes a set of shear rams 19 in the preferred embodiment. Shear rams 19 are used to completely close access to the well in an event of an emergency, and will cut any lines or pipe within the well bore. Pipe rams 17, 19 may be controlled by ultrasonic signals or they may be controlled by an umbilical leading to the surface.

A riser 21 extends from shear rams 19 upward. Most drilling risers use flanged ends on the individual riser pipes that bolt together. Riser 21, on the other hand, preferably utilizes casing with threaded ends that are secured together, the casing being typically smaller in diameter than a conventional drilling riser. Riser 21 extends upward past sea level 23 to a blowout prevent ("BOP") stack 25. BOP stack 25 is an assembly of pressure control equipment that will close on the outer diameter of a size range of tubular members as well as fully close when a tubular member is not located within. BOP stack 25 serves as the primary pressure control unit for the drilling and completion operation.

Riser 21 and BOP stack 25 are supported by a tensioner (not shown) of a floating vessel or platform 27. Platform 27 may be of a variety of types and will have a derrick and draw works for drilling and completion operations.

FIG. 1 illustrates a string of production tubing 29 lowered into the well below wellhead 11. A tubing hanger 31, secured to the upper end of production tubing 29, lands in wellhead 11 in a conventional manner. A conventional tubing hanger running tool 33 releasably secures to tubing hanger 31 for running and locking it to wellhead 11, and for setting a seal between tubing hanger 31 and the inner diameter of wellhead 11. Tubing hanger running tool 33 typically includes a quick disconnect member 35 on its upper end that extends through rams 17, 19. Rams 17 will be able to close and seal on disconnect member 35. Disconnect member 35 is secured to the lower end of a string of conduit 37, which may also be tubing or it could be drill pipe. Disconnect member 35 allows running tool 33 to be disconnected from conduit 37 in the event of an emergency.

An umbilical line 39 extends alongside conduit 37 for supplying hydraulic and electrical power to running tool 33. Umbilical line 39 comprises a plurality of separate lines within a jacket for controlling the various functions of running tool 33. The functions include supplying hydraulic fluid pressure to running tool 33 for engaging and disengaging with tubing hanger 31, to a lockdown mechanism for tubing hanger 31, and to a piston member for setting a seal. Umbilical line 39 may also includes electrically conductive wires. The electrical functions, if employed, may include sensing various positions of the running tool 33 and measuring fluid pressures during testing. The various lines that make up umbilical line 39 extend through disconnect member 35.

Figure 2:
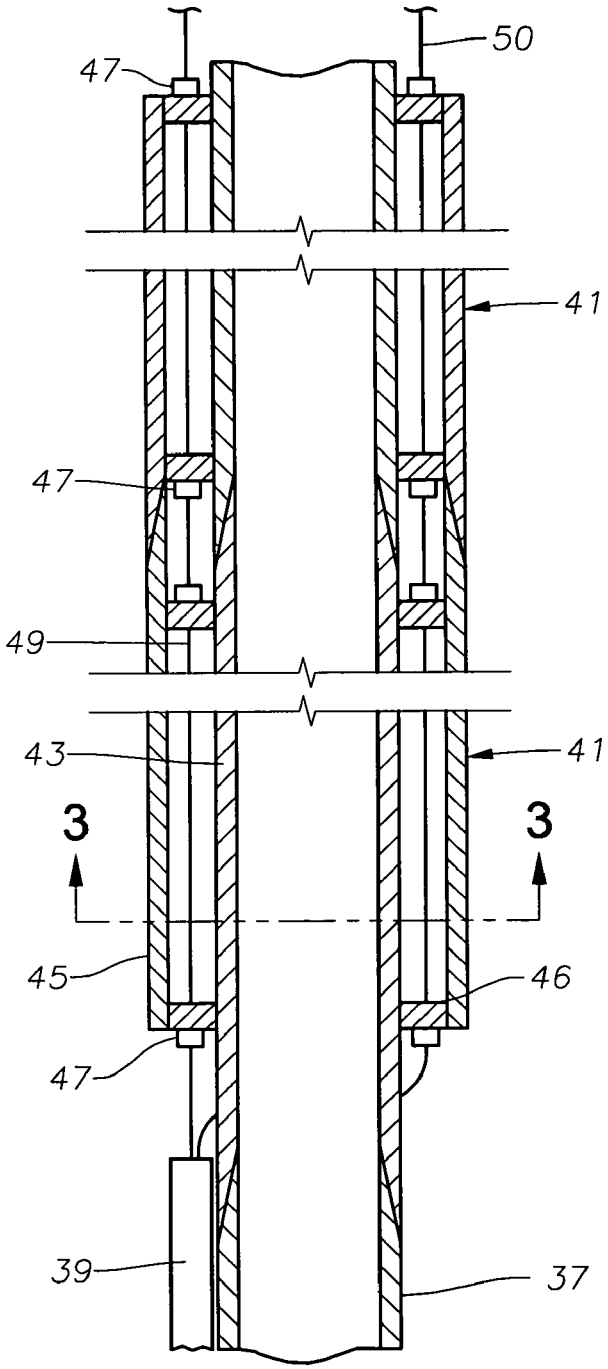
FIG. 2 is a schematic vertical sectional view of portions of two of the upper slick joints of the riser system of FIG. 1.
Figure 3:
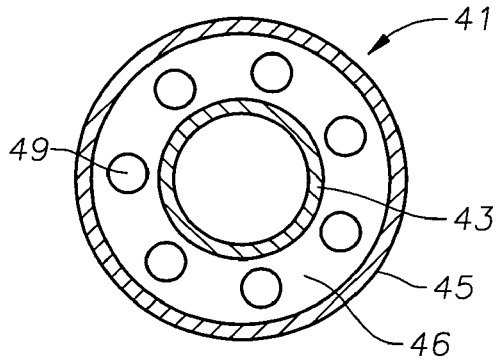
FIG. 3 is a schematic sectional view of the slick joints of FIG. 2, taken along the line 3-3 of FIG. 2.

At least one upper slick joint 41 is secured to the upper end of conduit 37. FIG. 2 illustrates two upper slick joints 41, and they are connected to the upper end of conduit 37 at a point so that they will locate within BOP stack 25. Upper slick joints 41 provide a smooth cylindrical exterior for engagement by BOP stack 25.

As shown in FIG. 2, upper slick joint 41 has an inner conduit 43 that axially aligns and connects with conduit 37 to enable tools to pass through inner conduit 43 into conduit 37. Optionally, upper slick joint 41 could have another inner conduit (not shown) located alongside inner conduit 43 for communicating with the tubing annulus surrounding conduit 37. In this embodiment, communication is accomplished by connecting a flow line from the upper end of riser 21 below BOP 25 to platform 27.

Upper slick joint 41 has an outer conduit 45 that is of larger diameter than inner conduit 43, resulting in an annulus between inner conduit 43 and outer conduit 45. Outer conduit 45 has a smooth cylindrical exterior for sealing engagement by BOP stack 25 (FIG. 1). Preferably, upper and lower seal plates 46 at the upper and lower ends of each upper slick joint 41 seal the annular space between inner and outer conduits 43, 45. Penetrator connectors 47 are mounted to the upper and lower seal plates 46 at the upper and lower ends of upper slick joint 41. The various lines from umbilical 39 connect to lower penetrator connectors 47. Penetrator lines 49 extend through the annulus between upper and lower penetrator connectors 47. Lines 50 connect to the upper penetrator connections 47 and lead to a controller 51 on platform 27.

In the operation of the embodiment of FIG. 1, the operator performs drilling by running a drill string through riser 21 and wellhead 11. After the drilling has been completed, the operator runs the final string of casing (not shown) through riser 21 and cements the casing in place. The operator then runs tubing 29 on tubing hanger running tool 33. The operator straps umbilical line 39 alongside conduit 37 at selected intervals. When at the predetermined length, the operator connects the lines of umbilical 39 to penetrator connectors 47 of a lowermost slick joint 41. The operator assembles the desired number of slick joints 41 so that the uppermost slick joint 41 will extend above BOP 25 and the lowermost slick joint 41 will extend below BOP 25.

The operator runs control lines 50 from controller 51 to the uppermost penetrator connectors 47 (FIG. 2). The operator sets and locks tubing hanger 31 and sets the tubing hanger seals by providing hydraulic pressure through various lines in umbilical 39 to running tool 33. The operator may test the seal by closing surface BOP 25 around slick joints 41 and applying pressure to annulus fluid in riser 21. Subsequently, the operator may perforate by lowering a perforating gun through upper slick joints 41, conduit 37, lower disconnect member 35, running tool 33 and into tubing 29. The operator may circulate fluid through tubing 29 by pumping down conduit 37 and tubing 29, and returning the well fluid up the tubing annulus, or vice versa.

For emergency purposes, surface BOP 25 can be closed around upper slick joints 41. Similarly, sealing ram 17 can be closed around disconnect member 35. After the testing of the well has been completed, the operator supplies hydraulic power through umbilical 39 to running tool 33 to release it from tubing hanger 31 for retrieval.

Typically, a number of wells would be drilled in the same general area with the same drilling riser 21 (FIG. 1). If a new well is nearby, the operator may choose to leave drilling riser 21 assembled while platform 27 is being moved to the new location. The distance from surface BOP 25 to shear rams 19, however, may differ from well to well. The operator may need to disconnect surface BOP 25 and add or remove sections of riser 21. Preferably, the length of umbilical 39 is selected so that it does not change even though the length of riser 21 changes. The operator will select the length of umbilical 39 to be the maximum length of umbilical 39 that will work for the location having the shallowest water. That is, the lower end of upper slick joint 41 will be located only slightly below BOP 25 while drilling in the shallowest water. When running tubing 37 for the wells in the shallowest water depth, perhaps only one upper slick joint 41 is needed to span BOP 25. When drilling in deeper water, the operator adds sufficient upper slick joints 41 to extend at least part of the slick joints 41 through BOP 25. When coupling slick joints 41 together, the upper penetrator connectors 47 of one slick joint 41 will preferably stab into and connect to those of the next upper slick joint 41. Consequently, once umbilical line 39 is cut to the desired length, that length will not change for a selected range of water depth.

Figure 4:
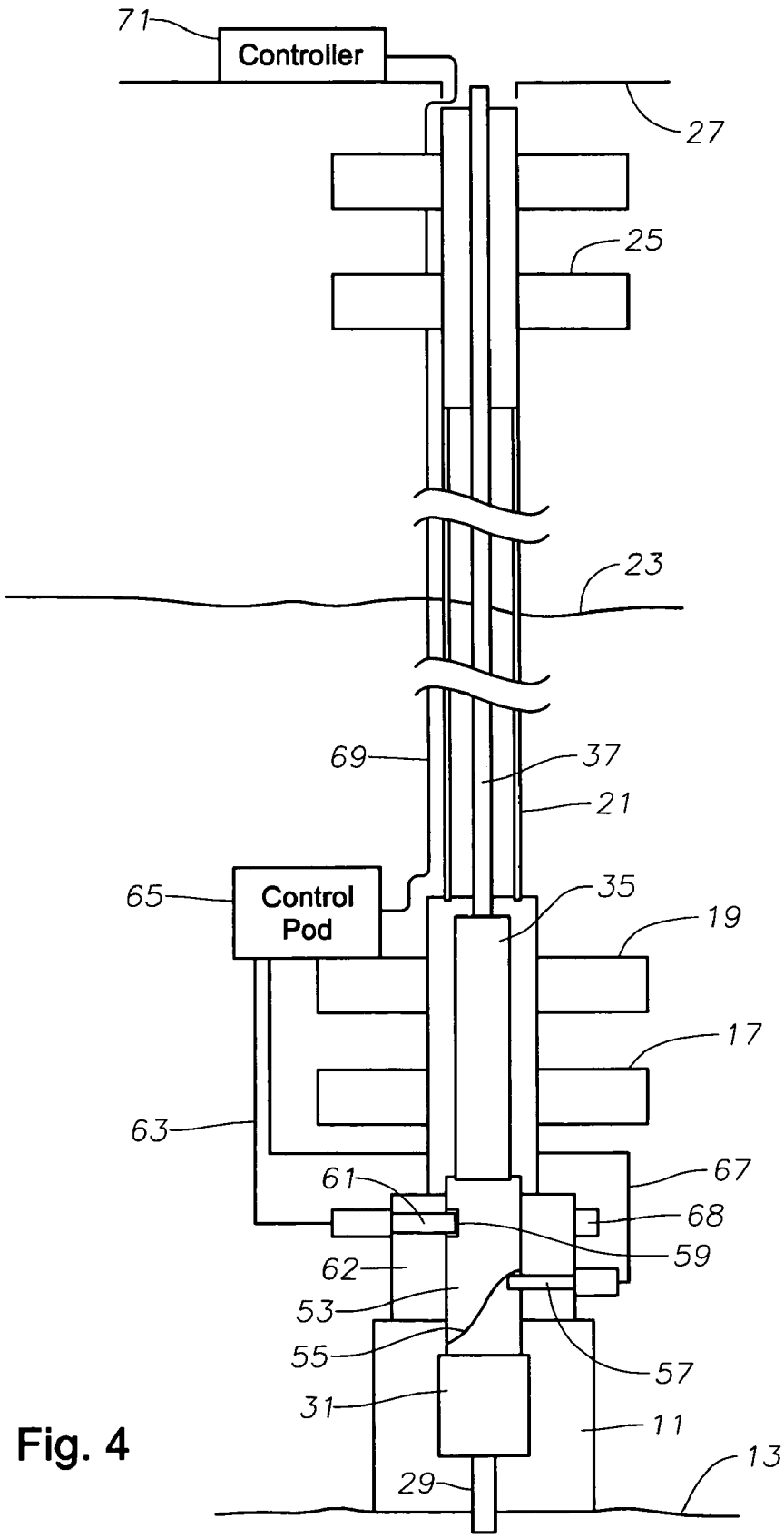
FIG. 4 is a schematic view of a second embodiment of a tubing hanger being run through a riser in accordance with this invention.

FIG. 4 discloses a second embodiment. In the embodiment of FIG. 4, running tool 53 has an orientation cam or slot 55 that is positioned to contact an orientation pin 57 mounted to the sidewall of adapter 62 below pipe rams 17. As cam slot 55 contacts orientation pin 57 while running tool 53 is being lowered, running tool 53 will rotate to a desired orientation relative to wellhead 11. Preferably, orientation pin 57 is retractable to not protrude into the bore of adapter 15 during normal drilling operations.

Running tool 53 has a receptacle 59 located on its sidewall that leads to various hydraulic and optionally electrical components of running tool 53. Receptacle 59 aligns with a reciprocal connector 61 when tubing hanger 31 is in the landing position and orientation pin 57 has properly oriented running tool 53. Reciprocal connector 61 is mounted to adapter 62 and has a plunger that extends out and sealingly engages receptacle 59.

A control line 63 extends from reciprocal connector 61 to a control pod 65. Control pod 65 is located subsea, preferably on a portion of the subsea pressure control equipment such as shear rams 19. Control pod 65 has electrical and hydraulic controls that preferably include a hydraulic accumulator that supplies pressurized hydraulic fluid-upon receipt of a signal. Control pod 65 connects to an umbilical 69 that is located on the exterior of riser 21, rather than in the interior as in the first embodiment. Umbilical 69 extends up to a controller 71 mounted on platform 27.

In the operation of the embodiment of FIG. 4, when running tubing hanger 31, the operator applies a signal to control pod 65 to cause orientation pin 57 to extend. Orientation pin 57 engages cam slot 55 and rotates running tool 53 to the desired alignment as running tool 53 moves downward. Control pod 65 provides the power via line 67 to stroke orientation pin 57, the power being either electrical or hydraulic. The operator signals control pod 65 to provide hydraulic power through line 63 to reciprocal connector 61. This causes connector 61 to advance into sealing engagement with receptacle 59. The operator then provides hydraulic pressure to the various lines via control pod 65 to cause running tool 53 to set tubing hanger 31.

The operator may also sense various functions, such as pressures or positions of components, through lines 63 and 69. Typically, the operator will test the seal of tubing hanger 31 to determine whether the seal has properly set. This may be done by applying pressure to the fluid in the annulus in riser 21 with BOP 25 closed around conduit 37. Alternately, testing may be done by utilizing a remote operated vehicle ("ROV" not shown in FIG. 4) to engage a test port 68 located in the sidewall of adapter 62. In that event, pipe rams 17 would be actuated to close around disconnect member 35 to confine the hydraulic pressure to a chamber between the seal of tubing hanger 31 and pipe rams 17. The ROV supplies the hydraulic pressure through an internal pressurized supply of hydraulic fluid. The pressure being exerted into such chamber could be monitored through lines 63 and 69 by controller 71.

Figure 5:
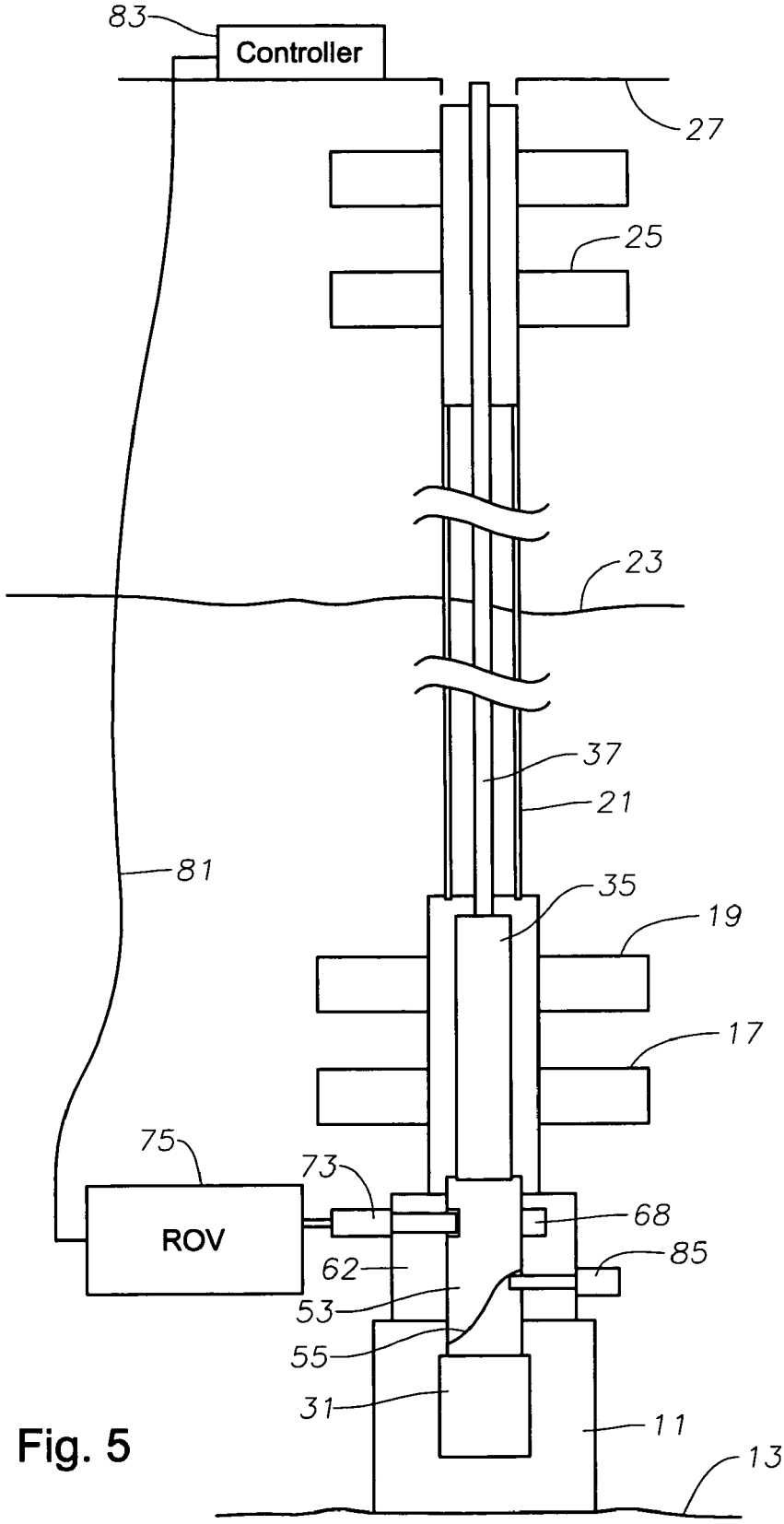
FIG. 5 is a schematic view of a third embodiment of a tubing hanger being run through a riser in accordance with this invention.

In the embodiment of FIG. 5, a reciprocal connector 73 is mounted to adapter 62. Reciprocal connector 73 is the same as connector 61 of FIG. 4, except that rather than being connected to a subsea control pod as in FIG. 4, it has a port that is engaged by an ROV 75. ROV 75 is a conventional type that is connected to the surface via umbilical 81 that connects to the controller 83. ROV 75 has a pressurized source within it that is capable of supplying hydraulic fluid pressure. Preferably, the pressure source will comprise an accumulator having a sufficient volume to stroke orientation pin 85 and reciprocal connector 73 but also operate running tool 53, and test the seal of tubing hanger 31.

In the operation of this embodiment, ROV 75 first connects to orientation pin 85 and extends it, then is moved to reciprocal connector 73. After running tool 53 has landed tubing hanger 31, ROV 75 strokes reciprocal connector 73 into engagement with running tool 53 and sets tubing hanger 31. Then ROV 75 moves over to test port 68 for providing hydraulic fluid pressure for test purposes in the same manner as described in connection with FIG. 4.

Figure 6:
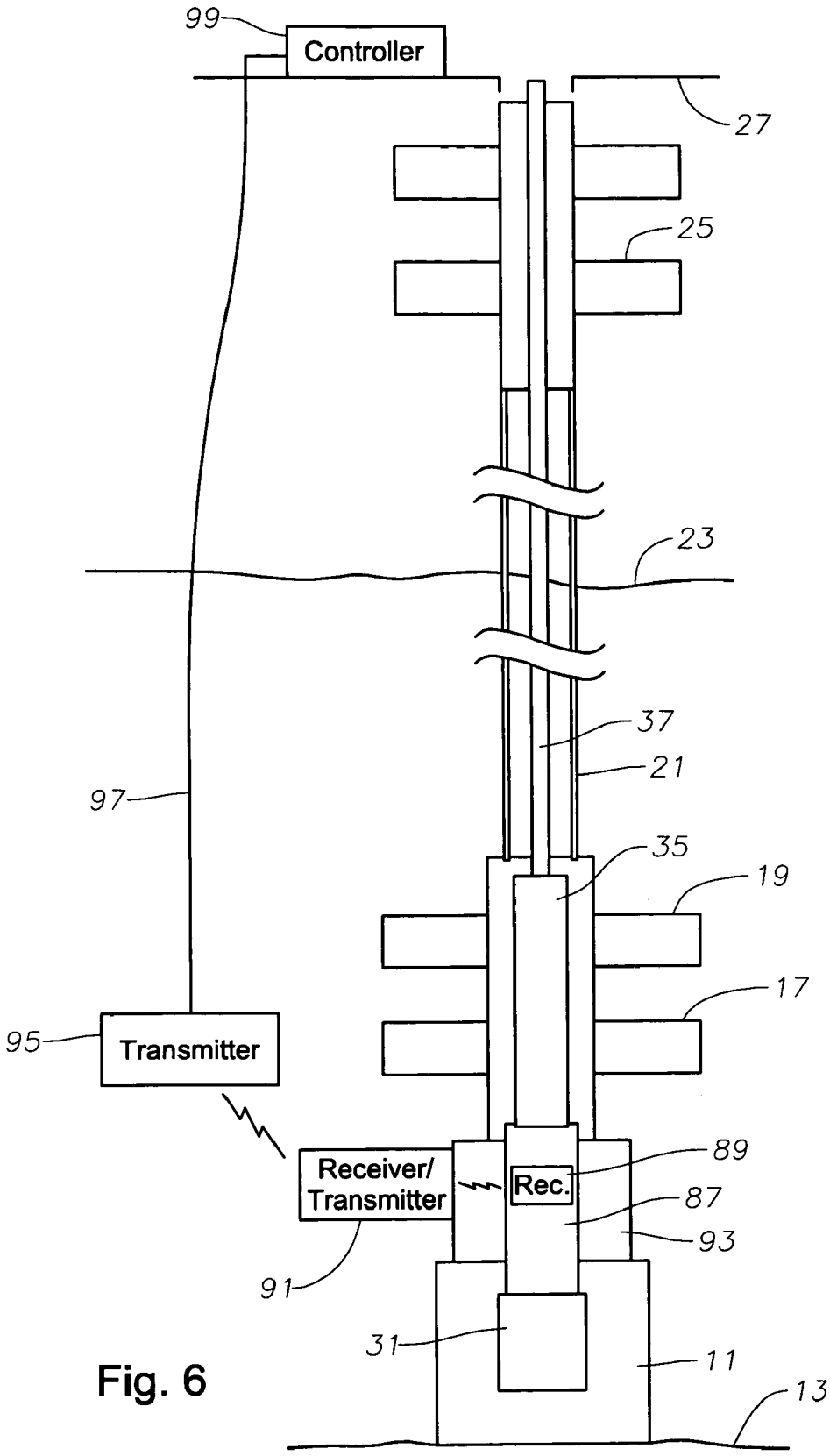
FIG. 6 is a schematic view of a fourth embodiment of a tubing hanger being run through a riser in accordance with this invention.

In the embodiment of FIG. 6, running tool 87 has an ultrasonic receiver 89 therein. A relay receiver/transmitter 91 mounts to adapter 93 and is in communication with the interior of adapter 93. Receiver/transmitter 91 communicates ultrasonic signals to running tool receiver 89. In this embodiment, running tool 87 has an internal pressure source, such as an accumulator, that contains adequate hydraulic fluid pressure for causing it to set and release from tubing hanger 31. A transmitter 95 is lowered into the sea on an umbilical line 97. Umbilical line 97 leads to a controller 99 on platform 27.

In the operation of the embodiment of FIG. 6, after tubing hanger 31 lands at the proper position, the operator supplies a signal to transmitter 95. Transmitter 95 provides an acoustical signal to receiver/transmitter 91, which in turn sends a signal to receiver 89. The signal will cause running tool 87 to perform a designated step. Receiver 89 thus controls electrical solenoids (not shown) within the electro-hydraulic controls of running tool 87. These solenoids distribute hydraulic pressurized fluid from the internal accumulator to perform the various functions of setting and releasing from tubing hanger 31.

In each of the embodiments described above, the power and hydraulic line or control line is not exposed well pressures during completion operations. These embodiments help to reduce the risks of shearing the umbilical line from the surface vessel to the running tool, or having a leak at the surface BOP because of the umbilical. The embodiments in FIGS. 2-6 also help to reduce the risks of the issues associated with conventional assemblies having the control lines extending through the riser while in fluid communication with the bore of the wellhead assembly.

While the invention has been shown in only some of its forms, it should be apparent to those skilled in the art that it is not so limited, but is susceptible to various changes without departing from the scope of the invention.

The invention is claimed is:

1. A method for performing an operation in a subsea wellhead assembly through a riser extending between the wellhead assembly and a surface platform, comprising:

(a) connecting a surface blowout preventer to an upper portion of the riser;

(b) connecting a tool to a string of conduit;

(c) connecting a control line to the tool, extending the control line alongside the conduit and lowering the tool and control line through the blowout preventer and the riser;

(d) mounting a slick joint to an upper end of the conduit when the tool is near the wellhead assembly, the slick joint having a central axial bore and a cylindrical exterior, and linking the control line to the surface platform through a control line passage located outward from the bore in the slick joint; and (e) communicating with the tool via the control line and performing an operation in the wellhead assembly with the tool.

2. The method of claim 1, further comprising closing the blowout preventer on the cylindrical exterior of the slick joint and applying pressure to the interior of the riser around the string of conduit.

3. The method of claim 1, wherein step (e) comprises sending electrical signals through the control line.

4. The method of claim 1, wherein step (d) comprises connecting the control line to a control line segment that extends through the control line passage in the slick joint.

5. The method of claim 1, wherein step (e) comprises:

closing the blowout preventer around the cylindrical exterior of the slick joint; and flowing fluid through the bore in the slick joint.

6. The method of claim 1, wherein:

the tool in step (b) comprises a running tool for running a string of pipe into the well; and step (e) comprises setting with the running tool a hanger at an upper end of the pipe, sealingly in the wellhead assembly.

7. A method for performing an operation in a subsea wellhead assembly through a riser extending between the wellhead assembly and a surface platform, comprising:

(a) connecting a surface blowout preventer to an upper portion of the riser;

(b) connecting to a string of conduit a running tool for running a string of pipe in the well;

(c) connecting a control line to the running tool, extending the control line alongside the conduit and lowering the running tool and control line through the blowout preventer and the riser;

(d) mounting a slick joint to an upper end of the conduit when the running tool is near the wellhead assembly, the slick joint having a central axial bore and a cylindrical exterior, and linking the control line to the surface platform through a control line passage extending axially through the slick joint outward from the axial bore;

(e) communicating with the running tool via the control line;

(f) setting with the running tool a hanger at an upper end of the pipes sealingly in the wellhead assembly; and (g) closing the blowout preventer around the cylindrical exterior of the slick joint and performing an operation in the wellhead assembly with the tool.

8. The method of claim 7, wherein step (d) comprises connecting the control line to a control line segment that extends through the control line passage in the slick joint.

9. The method of claim 7, wherein step (g) comprises applying pressure to the interior of the riser around the string of conduit.

10. The method of claim 7, wherein step (g) comprises flowing a fluid through the bore in the slick joint.

11. An offshore assembly associated with an offshore well, comprising:

a subsea wellhead assembly;

a riser extending from a surface vessel to the subsea wellhead assembly;

a tool lowered on a string of conduit through the riser for performing an operation in the wellhead assembly;

a slick joint assembly connected to the string of conduit and having a central axial bore therethrough and a control line passage extending axially therethrough radially outward from the bore;

a surface blowout preventer on the surface vessel; and a control line extending from the surface vessel through the control line passage of the slick joint assembly and alongside of the string of conduit to the running tool in the riser;

the slick joint assembly being located so as to be within the blowout preventer when the running tool reaches the wellhead assembly, so that the blowout preventer can be closed on the slick joint assembly.

12. The offshore assembly of claim 11, wherein the slick joint comprises a plurality of slick joints stacked on top of each other.

13. The offshore assembly of claim 11, wherein the control line passage is annular and surrounds the bore.

14. The offshore assembly of claim 11, wherein the length of the slick joint assembly is greater than a length of the blowout preventer.

15. The offshore assembly of claim 11, wherein the slick joint assembly comprises a plurality of slick joint sections connected together by threads.

16. The offshore assembly of claim 15, wherein a control line connector is located at upper and lower ends of each of the slick joint sections, and wherein the control line has a plurality of segments, each segment extending through one of the slick joint sections.

17. The offshore assembly of claim 11, wherein the control line comprises at least one electrical line.

18. The offshore assembly of claim 11, wherein the slick joint assembly comprises an inner pipe that secures into the string of conduit and defines the axial bore, a jacket surrounding the inner pipe, an annular space between the jacket and the inner pipe that defines the control line passage, and an upper seal plate and a lower seal plate sealing upper and lower ends of the jacket to the inner pipe.

19. The offshore assembly of claim 18, further comprising a plurality of penetrator connectors, with at least one penetrator connector being mounted to each of the upper and lower seal plates; and wherein the control line has segments extending between the penetrator connectors.

* * * * *

UNITED STATES PATENT AND TRADEMARK OFFICE

CERTIFICATE OF CORRECTION

PATENT NO. : 7,318,480 B2
APPLICATION NO. : 11/219443
DATED : January 15, 2008
INVENTOR(S) : Stanley Hosie It is certified that error appears in the above-identified patent and that said Letters Patent is hereby corrected as shown below:

Column 1, line 30:
delete "of landing"

Column 3, line 43:
delete "includes" and insert --include--

Column 6, line 34:
after "exposed" insert --to--

In the Claims:
Column 7, line 42:
delete "pipes" and insert --string of pipe--

Column 8, line 16:
after "the riser;" insert --and--

Column 8, line 22:
after "joint" insert --assembly--

Signed and Sealed this

Twenty-ninth Day of July, 2008

JON W. DUDAS
*Director of the United States Patent and Trademark Office*